US006254334B1

(12) United States Patent
LaFleur

(10) Patent No.: US 6,254,334 B1
(45) Date of Patent: Jul. 3, 2001

(54) METHOD AND APPARATUS FOR COOLING A WALL WITHIN A GAS TURBINE ENGINE

(75) Inventor: Ronald S. LaFleur, Potsdam, NY (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/412,274

(22) Filed: Oct. 5, 1999

(51) Int. Cl.[7] ..... F01D 5/14
(52) U.S. Cl. ..... 415/115; 416/97 R
(58) Field of Search ..... 415/115; 416/97 R, 416/97 A, 96 R

(56) References Cited

U.S. PATENT DOCUMENTS

| | | | |
|---|---|---|---|
| 3,819,295 | 6/1974 | Hauser et al. | 416/97 |
| 3,902,820 | 9/1975 | Amos | 416/97 |
| 3,973,874 | 8/1976 | Corsmeier et al. | 416/97 A |
| 4,021,139 | 5/1977 | Franklin | 416/97 R |
| 4,042,162 | 8/1977 | Meginnis et al. | 228/106 |
| 4,080,095 | 3/1978 | Stahl | 415/178 |
| 4,185,369 | 1/1980 | Darrow et al. | 29/156.8 B |
| 4,203,706 | 5/1980 | Hess | 416/97 A |
| 4,221,539 | 9/1980 | Corrigan | 416/97 A |
| 4,353,679 | 10/1982 | Hauser | 415/115 |
| 4,487,550 | 12/1984 | Horvath et al. | 416/92 |
| 4,529,358 | 7/1985 | Papell | 416/97 A |
| 4,542,867 | 9/1985 | Memmen | 244/117 A |
| 4,601,638 | 7/1986 | Hill et al. | 416/97 R |
| 4,669,957 | 6/1987 | Phillips et al. | 416/97 R |
| 4,684,322 | 8/1987 | Clifford et al. | 416/95 |
| 4,768,700 | 9/1988 | Chen | 228/159 |
| 4,776,172 | 10/1988 | Havercroft | 60/754 |
| 5,340,074 | 8/1994 | Cunha | 415/115 |
| 5,344,283 | 9/1994 | Magowan et al. | 415/115 |
| 5,370,499 | 12/1994 | Lee | 416/97 R |
| 5,383,766 * | 1/1995 | Przirembel et al. | 416/97 A |
| 5,392,515 * | 2/1995 | Auxier et al. | 29/889.721 |
| 5,403,159 | 4/1995 | Green et al. | 416/97 R |
| 5,413,458 | 5/1995 | Calderbank | 415/115 |
| 5,484,258 | 1/1996 | Isburgh et al. | 415/115 |
| 5,695,320 | 12/1997 | Kercher | 416/97 R |
| 5,771,577 | 6/1998 | Gupta et al. | 29/889.721 |
| 5,813,836 | 9/1998 | Starkweather | 416/97 R |
| 5,820,337 | 10/1998 | Jackson et al. | 415/200 |
| 5,822,853 | 10/1998 | Ritter et al. | 29/890.01 |

OTHER PUBLICATIONS

"Advanced Airfoil Fabrication", James R. Dobbs and Jeffrey A. Graves, General Electric Company, Corporate Research and Development, Schenectady, NY 12301, Sergey Meshkov, Rybinsk Motor–Building Design Bureau, Rybinsk, Yaroslavi Region, Russia, pp. 523–529.

* cited by examiner

*Primary Examiner*—Edward K. Look
*Assistant Examiner*—James M. McAleenan
(74) *Attorney, Agent, or Firm*—Richard D. Getz

(57) ABSTRACT

According to the present invention, a method and an apparatus for cooling a wall within a gas turbine engine is provided. The apparatus includes and the method provides for a cooling circuit disposed within a wall having utility within a gas turbine engine. The cooling circuit includes a forward end, an aft end. The pedestals extend between first and second portions of the wall. The characteristics and array of the pedestals within the cooling circuit are chosen to provide a heat transfer cooling profile within the cooling circuit that substantially offsets the profile of the thermal load applied to the wall portion containing the cooling circuit. At least one inlet aperture provides a cooling airflow path into the forward portion of the cooling circuit from the cavity. A plurality of exit apertures provide a cooling airflow path out of the aft portion of the cooling circuit and into the core gas path outside the wall.

12 Claims, 3 Drawing Sheets

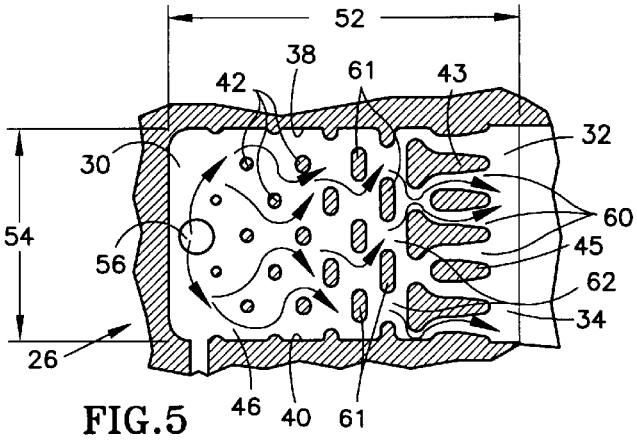
FIG.5
FIG.5A
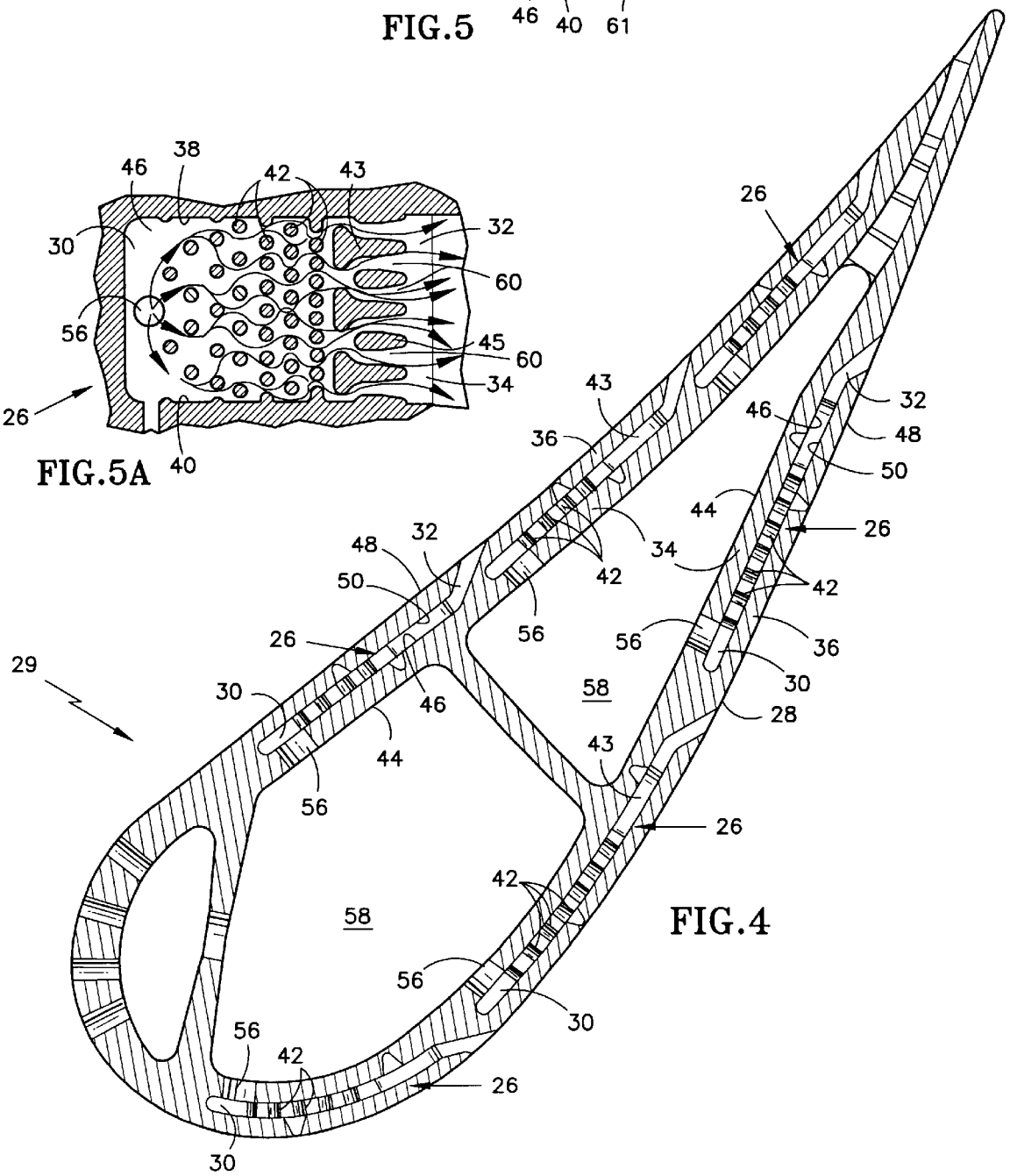
FIG.4

METHOD AND APPARATUS FOR COOLING A WALL WITHIN A GAS TURBINE ENGINE

BACKGROUND OF THE INVENTION

1. Technical Field

This invention relates to gas turbine engines in general, and to cooling passages disposed within a wall inside of a gas turbine engine in particular.

2. Background Information

A typical gas turbine engine includes a fan, compressor, combustor, and turbine disposed along a common longitudinal axis. The fan and compressor sections work the air drawn into the engine, increasing the pressure and temperature of the air. Fuel is added to the worked air and the mixture is burned within the combustor. The combustion products and any unburned air, hereinafter collectively referred to as core gas, subsequently powers the turbine and exits the engine producing thrust. The turbine comprises a plurality of stages each having a rotor assembly and a stationary vane assembly. The core gas passing through the turbine causes the turbine rotors to rotate, thereby enabling the rotors to do work elsewhere in the engine. The stationary vane assemblies located forward and/or aft of the rotor assemblies guide the core gas flow entering and/or exiting the rotor assemblies. Liners, which include blade outer air seals, maintain the core gas within the core gas path that extends through the engine.

The extremely high temperature of the core gas flow passing through the combustor, turbine, and nozzle necessitates cooling in those sections. Combustor and turbine components are cooled by air bled off a compressor stage at a temperature lower and a pressure greater than that of the core gas. The nozzle (and augmentor in some applications) is sometimes cooled using air bled off of the fan rather than off of a compressor stage. There is a trade-off using compressor (or fan) worked air for cooling purposes. On the one hand, the lower temperature of the bled compressor air provides beneficial cooling that increases the durability of the engine. On the other hand, air bled off of the compressor does not do as much work as it might otherwise within the core gas path and consequently decreases the efficiency of the engine. This is particularly true when excessive bled air is used for cooling purposes because of inefficient cooling.

One cause of inefficient cooling can be found in cooling air that exits the wall with unspent cooling potential. A person of skill in the art will recognize that cooling air past through a conventional cooling aperture typically contains cooling potential that is subsequently wasted within the core gas flow. The present invention provides convective cooling means that can be tailored to remove an increased amount of cooling potential from the cooling air prior to its exit thereby favorably affecting the cooling effectiveness of the wall.

Another cause of inefficient cooling can be found in poor film characteristics in those applications utilizing a cooling air film to cool a wall. In many cases, it is desirable to establish film cooling along a wall surface. A film of cooling air traveling along the surface of the wall increases the uniformity of the cooling and insulates the wall from the passing hot core gas. A person of skill in the art will recognize, however, that film cooling is difficult to establish and maintain in the turbulent environment of a gas turbine. In most cases, air for film cooling is bled out of cooling apertures extending through the wall. The term "bled" reflects the small difference in pressure motivating the cooling air out of the internal cavity of the airfoil. One of the problems associated with using apertures to establish a cooling air film is the film's sensitivity to pressure difference across the apertures. Too great a pressure difference across an aperture will cause the air to jet out into the passing core gas rather than aid in the formation of a film of cooling air. Too small a pressure difference will result in negligible cooling airflow through the aperture, or worse, an in-flow of hot core gas. Both cases adversely affect film cooling effectiveness. Another problem associated with using apertures to establish film cooling is that cooling air is dispensed from discrete points, rather than along a continuous line. The gaps between the apertures and areas immediately downstream of those gaps are exposed to less cooling air than are the apertures and the spaces immediately downstream of the apertures, and are therefore more susceptible to thermal degradation.

Hence, what is needed is an apparatus and a method for cooling a wall that can be tailored to provide a heat transfer profile that matches a thermal load profile, one that effectively removes cooling potential from cooling air, and one that facilitates film cooling.

DISCLOSURE OF THE INVENTION

It is, therefore, an object of the present invention to provide an apparatus and method for cooling a wall having a selectively adjustable heat transfer profile that can be adjusted to substantially match a thermal load profile.

According to the present invention, a cooling circuit is disposed within a wall inside a gas turbine engine. The cooling circuit includes a forward end, an aft end, a first wall portion, a second wall portion, and a plurality of pedestals. The first and second wall portions extend lengthwise between the forward and aft ends of the cooling circuit, and are separated a distance from one another. The pedestals extend between the first and second wall portions. The characteristics and array of the pedestals within the cooling circuit are chosen to provide a heat transfer cooling profile within the cooling circuit that substantially offsets the profile of the thermal load applied to the wall portion containing the cooling circuit. At least one inlet aperture extends through the first wall portion to provide a cooling airflow path into the forward portion of the cooling circuit from the cavity. A plurality of exit apertures extend through the second wall portion to provide a cooling airflow path out of the aft portion of the cooling circuit and into the core gas path outside the wall.

The present cooling circuits are designed to accommodate non-uniform thermal profiles. The temperature of cooling air traveling through a passage, for example, increases exponentially as a function of the distance traveled within the passage. The exit of a cooling aperture is consequently exposed to higher temperature, and therefore less effective, cooling air than is the inlet. In addition, the wall portion containing the passage is often externally cooled by a film of cooling air. The film of cooling air increases in temperature and degrades as it travels aft, both of which result in a decrease in cooling and consequent higher wall temperature traveling in the aft direction. To ensure adequate cooling across such a non-uniform thermal profile (typically present in a conventional cooling passage) it is necessary to base the cooling scheme on the cooling requirements of the wall where the thermal load is the greatest, which is typically just upstream of the exit of the cooling passage. As a result, the wall adjacent the inlet of the cooling passage (i.e., where the cooling air within the passage and the film cooling along the outer surface of the wall are the most effective) is often overcooled. The present invention cooling circuit advantageously avoids undesirable overcooling by providing a method and an apparatus capable of creating a heat transfer cooling profile that substantially offsets the profile of the thermal load applied to the wall portion along the length of the cooling circuit.

Another advantage of the present cooling circuits is a decrease in thermal stress within the component wall. Thermal stress often results from temperature gradients within the wall; the steeper the gradient, the more likely it will induce undesirable stress within the wall. The ability of the present cooling circuit to produce a heat transfer profile that substantially offsets the local thermal load profile of the wall decreases the possibility that thermal stress will grow within the wall.

Another advantage of the present cooling circuit is that it decreases the possibility of hot core gas inflow. Each cooling circuit is an independent compartment designed to internally provide a plurality of incremental pressure drops between the inlet aperture(s) and the exit apertures. The pressure drops allow for a low pressure drop across the inlet aperture and that increases the likelihood that there will always be a positive flow of cooling air into the cooling circuit. The positive flow of cooling air through the circuit, in turn, decreases the chance that hot core gas will undesirably flow into the cooling circuit.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 4 is a diagrammatic is a cross-sectional view of an airfoil having a plurality of the present cooling circuits disposed within the wall of the airfoil.

FIG. 5 is an enlarged diagrammatic view of one of the present invention cooling circuits illustrating certain pedestal characteristics.

FIG. 5A is an enlarged diagrammatic view of one of the present invention cooling circuits illustrating certain pedestal characteristics.

DETAILED DESCRIPTION OF THE INVENTION

Figure 1:
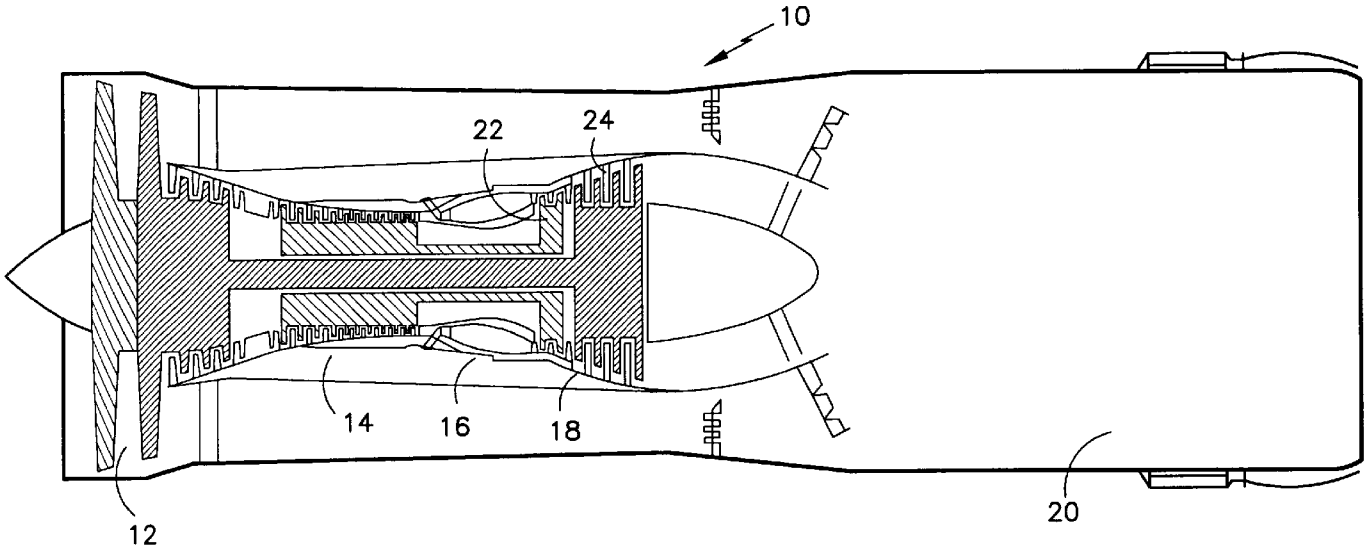
FIG. 1 is a diagrammatic view of a gas turbine engine.
Figure 2:
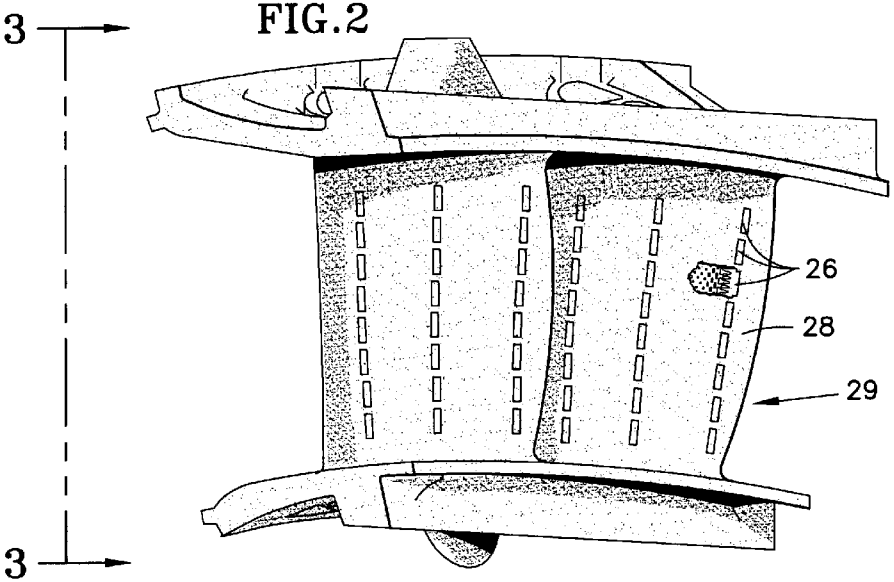
FIG. 2 is a diagrammatic view of a gas turbine engine stator vane that includes a plurality of the present invention cooling circuits, of which the aft ends can be seen extending out of the vane wall.
Figure 3:
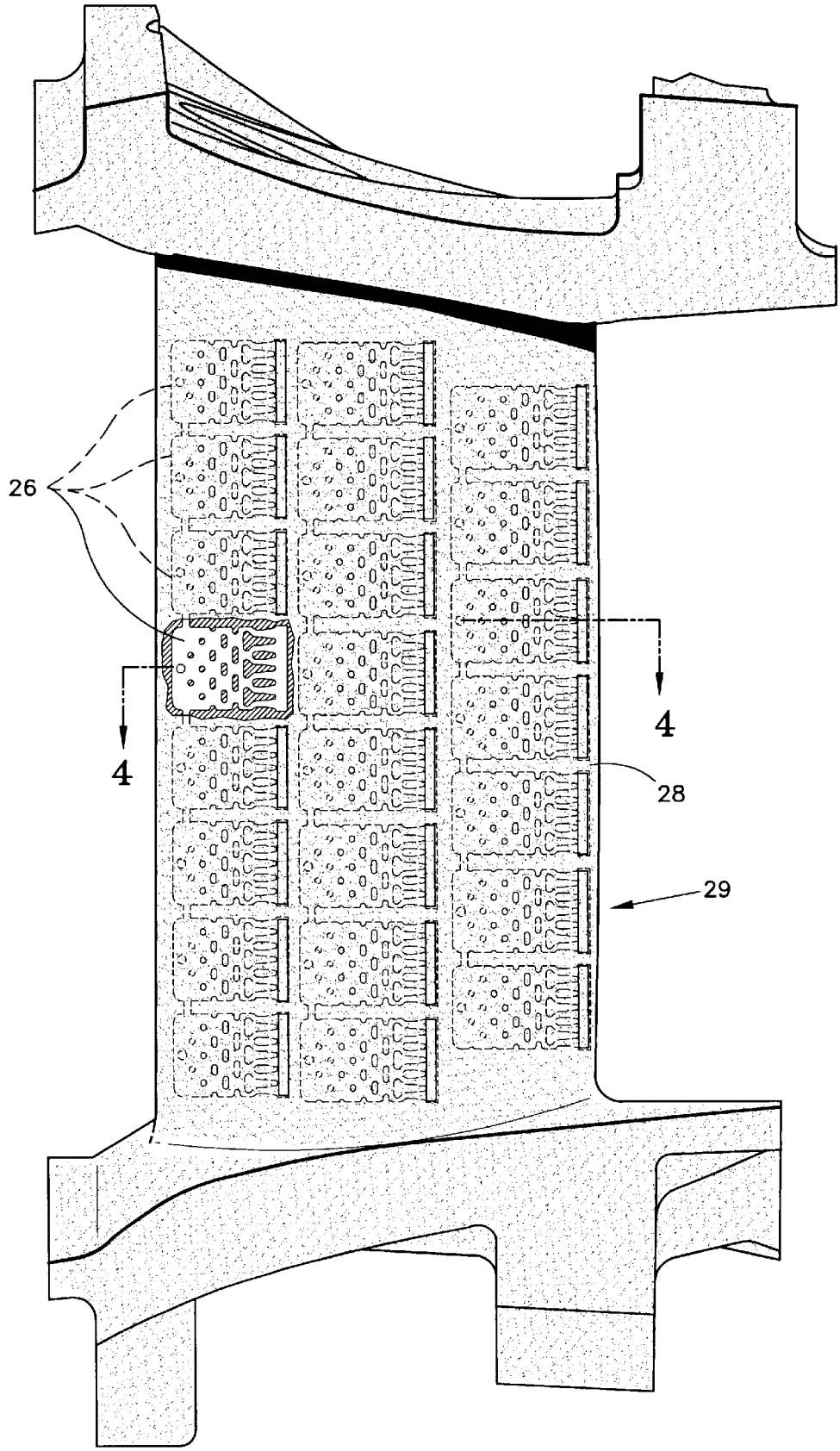
FIG. 3 is a diagrammatic view of a gas turbine engine stator vane showing a plurality of the present cooling circuits exposed for illustration sake.

Referring to FIGS. 1 and 2, a gas turbine engine 10 includes a fan 12, a compressor 14, a combustor 16, a turbine 18, and a nozzle 20. Within and aft of the combustor 16, most components exposed to core gas are cooled because of the extreme temperature of the core gas. The initial rotor stages 22 and stator vane stages 24 within the turbine 18, for example, are cooled using cooling air bled off a compressor stage 14 at a pressure higher and temperature lower than the core gas passing through the turbine 18. The cooling air is passed through one or more cooling circuits 26 (FIG. 2) disposed within a wall to transfer thermal energy from the wall to the cooling air. Each cooling circuit 26 can be disposed in any wall that requires cooling, and in most cases the wall is exposed to core gas flow on one side and cooling air on the other side. For purposes of giving a detailed example, the present cooling circuit 26 will be described herein as being disposed within a wall 28 of an airfoil 29 portion of a stator vane or a rotor blade. The present invention cooling circuit 26 is not limited to those applications, however, and can be used in other walls (e.g., liners, blade seals, etc.) exposed to high temperature gas.

Referring to FIGS. 2–5 and 5A, each cooling circuit 26 includes a forward end 30, an aft end 32, a first wall portion 34, a second wall portion 36, a first side 38, a second side 40, a plurality of first pedestals 42, and a plurality of alternately disposed T-shaped second pedestals 43 and third pedestals 45. The third pedestals are shaped to nest between adjacent T-shaped second pedestals 43. The first wall portion 34 has a cooling-air side surface 44 and a circuit-side surface 46. The second wall portion 36 has a core-gas side surface 48 and a circuit-side surface 50. The first wall portion 34 and the second wall portion 36 extend lengthwise 52 between the forward end 30 and the aft end 32 of the cooling circuit 26, and widthwise 54 between the first side 38 and second side 40. The plurality of first pedestals 42 extend between the circuit-side surfaces 46,50 of the wall portions 34,36. At least one inlet aperture 56 extends through the first wall portion 34, providing a cooling airflow path into the forward end 30 of the cooling circuit 26 from the cavity 58 of the airfoil 29. A plurality of exit apertures 60 extend through the second wall portion 36 to provide a cooling airflow path out of the aft end 32 of the cooling circuit 26 and into the core gas path outside the wall 28. The exit apertures 60 are formed between the T-shaped second pedestals 43 and nested third pedestals 45, the first wall portion 34, and the second wall portion 36.

The size, number, and position of the first pedestals 42 within the cooling circuit 26 are chosen to provide a heat transfer cooling profile within the cooling circuit 26 that substantially offsets the profile of the thermal load applied to the portion of the wall containing the cooling circuit 26; i.e., the cooling circuit may be selectively "tuned" to offset the thermal load. For example, if a portion of wall is subjected to a thermal load that increases in the direction extending forward to aft (as is described above), the size and distribution of the first pedestals 42 within the present cooling circuit 26 are chosen to progressively increase the heat transfer rate within the cooling circuit 26, thereby providing greater heat transfer where it is needed to offset the thermal load.

Decreasing the circuit cross-sectional area at a lengthwise position (or successive positions if the thermal load progressively increases), is one way to progressively increase the heat transfer within the cooling circuit 26. For clarity sake, the "circuit cross-sectional area" shall be defined as the area within a plane extending across the width 54 of the circuit through which cooling air may pass. The decrease in the circuit cross-sectional area will cause the cooling air to increase in velocity and the increased velocity will positively affect convective cooling in that region. Hence, the increase in heat transfer rate. If, for example, all of the first pedestals 42 have the same cross-sectional geometry, increasing the number of first pedestals 42 at a particular lengthwise position within the circuit 26 will decrease the circuit cross-sectional area. The circuit cross-sectional area can also be decreased by increasing the width or changing the geometry of the first pedestals 42 to decrease the distance between adjacent first pedestals 42. The heat transfer rate can also adjusted by utilizing impingement cooling or tortuous paths that promote convective cooling. FIG. 5 shows a distribution of first pedestals 42 that includes first pedestals 42 disposed downstream of and aligned with gaps 62 between upstream first pedestals 42. Cooling air traveling through the upstream gaps 62 is directed toward the downstream pedestals 61 elongated in a widthwise direction. The positioning of the second pedestals 43 encourages impingement cooling.

The amount by which the convective cooling is increased at any particular lengthwise position within the cooling circuit 26 depends upon the thermal load for that position, for that particular application. It is also useful to size the inlet aperture 56 of the cooling circuit 26 to produce a minimal pressure difference across the aperture 56, thereby preserving cooling potential for downstream use within the cooling circuit 26. A cooling circuit heat transfer profile that closely offsets the wall's thermal local thermal load profile will increase the uniformity of the temperature profile across the length of the cooling circuit, ideally creating a constant temperature within the wall portion 36.

Although this invention has been shown and described with respect to the detailed embodiments thereof, it will be understood by those skilled in the art that various changes in form and detail thereof may be made without departing from the spirit and scope of the claimed invention.

What is claimed is:

1. A coolable airfoil, comprising:

a body having a wall;

a cavity surrounded by said wall;

at least one cooling circuit disposed in said wall, said cooling circuit having a length extending between a forward end and an aft end, and a width extending between a pair of sides, wherein said cooling circuit includes:

a first wall portion;

a second wall portion;

a plurality of first pedestals extending between said first wall portion and said second wall portion;

an inlet aperture disposed in said wall, providing a cooling air flow path between said cavity and said forward end of said cooling circuit; and a plurality of exit apertures disposed in said second wall portion, providing a cooling air flow path between said aft end of said cooling circuit and outside said wall;

wherein said cooling circuit has a flow area within a plane extending widthwise across said cooling circuit, and wherein said flow area progressively decreases within said cooling circuit from said inlet aperture to said exit apertures.

2. The coolable airfoil of claim 1, wherein said first pedestals are substantially uniform in cross-section and arranged in widthwise extending rows, and beginning with a first said row closest to said inlet aperture, each subsequent row downstream of said first row includes a number of said first pedestals that is equal to or greater than the number of said first pedestals in an upstream row.

3. The coolable airfoil of claim 1, wherein said first pedestals are arranged in widthwise extending rows, and beginning with a first row closest to said inlet aperture, each said first pedestal within each subsequent said row downstream of said first row has a width greater than or equal to said first pedestals within an upstream row.

4. The coolable airfoil of claim 1, further comprising:

a row of alternately disposed second pedestals and third pedestals located along said aft end of said cooling circuit, wherein said exit apertures are formed between said second and third pedestals and said first and second wall portions.

5. A cooling circuit disposed within a wall, said cooling circuit comprising:

a passage having a first end, a second end, and a width, said passage disposed between a first wall portion and a second wall portion;

a plurality of pedestals disposed within said passage, extending between wall portions;

an inlet aperture, providing a cooling air flow path between a first side of wall and said first end of said passage; and a plurality of exit apertures extending through said second wall portion, providing a cooling air flow path between said second end of said passage and a second side of said wall;

wherein said cooling circuit has a flow area within a plane extending widthwise across said passage, and wherein said flow area decreases within said cooling circuit from said inlet aperture to said exit apertures.

6. The cooling circuit of claim 5, further comprising:

a row of alternately disposed second pedestals and third pedestals located along said aft end of said cooling circuit, wherein said exit apertures are formed between said second and third pedestals and said first and second wall portions.

7. A method for cooling a wall comprising the steps of:

(a) providing a cooling circuit within said wall, said cooling circuit including:

a passage having a first end, a second end, and a width, said passage disposed between a first wall portion and a second wall portion;

a plurality of first pedestals disposed within said passage, extending between wall portions;

an inlet aperture that provides a cooling air flow path between a first side of wall and said first end of said passage; and a plurality of exit apertures that extend through said second wall portion and provide a cooling air flow path between said second end of said passage and a second side of said wall;

(b) providing operating conditions that include a thermal load profile adjacent said cooling circuit to which said wall is likely to be exposed; and (c) selectively tuning said cooling circuit to provide a heat transfer profile under said operating conditions that substantially offsets said thermal load profile adjacent said cooling circuit.

8. The method of claim 7, wherein said cooling circuit includes a flow area within a plane extending widthwise across said passage, and said cooling circuit is selectively tuned by arranging said pedestals in a way that decreases said flow area, consequently increasing said heat transfer to offset the local thermal load.

9. The method of claim 7, wherein said pedestals are substantially similar in cross-section and said pedestals are arranged in rows and said flow area is decreased by increasing the number of first pedestals in one or more of said rows.

10. The method of claim 7, wherein said pedestals are arranged in rows and said flow area is decreased by increasing the width of said first pedestals in one or more of said rows.

11. A hollow airfoil having a cavity surrounded by a wall, comprising:

at least one cooling circuit disposed in said wall between a first and a second portion of said wall, said cooling circuit having a forward end, an aft end, a width that extends between a pair of sides, a plurality of first pedestals extending between said first wall portion and said second wall portion, an inlet aperture disposed in said wall that provides a cooling air flow path between said cavity and said forward end of said cooling circuit, and a plurality of exit apertures disposed in said second wall portion that provide a cooling air flow path between said aft end of said cooling circuit and outside said wall;

wherein said cooling circuit has a flow area within a plane extending widthwise across said cooling circuit, and wherein said flow area decreases within said cooling circuit from said inlet aperture to said exit apertures.

12. A cooling circuit disposed within a wall, said cooling circuit comprising:

a passage having a first end, a second end, and a width, said passage disposed between a first wall portion and a second wall portion;

a plurality of first pedestals disposed within said passage, extending between wall portions;

a plurality of T-shaped second pedestals;

a third pedestals of third pedestals, wherein said pedestals and said third pedestals are alternately disposed and said third pedestals nest between adjacent second pedestals;

an inlet aperture, providing a cooling air flow path between a first side of wall and said first end of said passage; and a plurality of exit apertures extending through said second wall portion providing a cooling air flow path between said second end of said passage and a second side of said wall, said exit apertures formed between said second pedestals and said third pedestals.

* * * * *